US007098417B1

(12) United States Patent
Fuji

(10) Patent No.: US 7,098,417 B1
(45) Date of Patent: Aug. 29, 2006

(54) SURFACE PRESSING BUTTON AND ELECTRONIC DEVICE INCLUDING THE SAME

(75) Inventor: Tadanari Fuji, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/348,480

(22) Filed: Feb. 7, 2006

(30) Foreign Application Priority Data

Feb. 8, 2005 (JP) ..... 2005-031592

(51) Int. Cl.
*H01H 13/705* (2006.01)

(52) U.S. Cl. ..... 200/343; 200/296

(58) Field of Classification Search ..... 200/5 R, 200/5 A, 396, 341–345
See application file for complete search history.

(56) References Cited

U.S. PATENT DOCUMENTS 5,892,192 A * 4/1999 Ishiguro et al. ..... 200/5 R
6,492,605 B1 * 12/2002 Iida ..... 200/343
6,570,111 B1 * 5/2003 Nakagawa et al. ..... 200/343
6,633,011 B1 * 10/2003 Ogawa et al. ..... 200/343
6,914,206 B1 * 7/2005 Mukougawa ..... 200/556
7,002,086 B1 * 2/2006 Fuji ..... 200/305
7,019,237 B1 * 3/2006 Hong ..... 200/296

FOREIGN PATENT DOCUMENTS

JP U-06-9023 2/1994
JP A-2004-039324 2/2004

* cited by examiner

*Primary Examiner*—Michael A. Friedhofer
(74) *Attorney, Agent, or Firm*—Morgan, Lewis & Bockius, LLP

(57) ABSTRACT

An auxiliary supporting frame of an electronic device that has a stopper hole to which a portion of a projection of a surface pressing part is inserted. The stopper hole is open in a direction that a front cover of the surface pressing button is mounted, and a stopper formed on a side opposite to the open side. Therefore, the surface pressing button can be surely and easily mounted on a back surface of a front panel, and a large load can be prevented from being applied to a switch.

8 Claims, 7 Drawing Sheets

SURFACE PRESSING BUTTON AND ELECTRONIC DEVICE INCLUDING THE SAME

CROSS-REFERENCE TO RELATED APPLICATION

This application claims priority under Japanese Patent Application No. 2005-031592 filed on Feb. 8, 2005 in Japan, the entire contents of which are incorporated herein by reference.

BACKGROUND OF THE INVENTION

1. Field of the Invention

The present invention relates to a surface pressing button, and an electronic device including the surface pressing button, such as an audio device or a video device.

2. Description of the Prior Art

An electronic device such as an audio device or a video device includes many surface pressing buttons to perform operations of the electronic device, on a front surface in many cases. In case that the electronic device is a DVD (Digital Versatile Disc) player, it includes surface pressing buttons capable of performing operations such as power ON/OFF, playback, stop, and disc ejection, so that the operation related to the surface pressing button can be performed by pressing the surface pressing button.

FIG. 6 is a front view showing a DVD player which is an example of a conventional electronic device. A DVD player PM shown in FIG. 6 includes a slot Ih for a DVD medium, a power supply button 91*p*, a stop button 91*a*, a playback (pause) button 91*b*, a medium ejection button 91*c* to eject the DVD medium, and a front panel 92 on which the aforementioned buttons are provided.

FIG. 7A is a sectional view showing a push button of the electronic device shown in FIG. 6 and FIG. 7B is a sectional view showing a mounting part of the electronic device shown in FIG. 6. As shown in FIGS. 7A and 7B, the surface pressing button 91 is arranged so that a surface pressing part 911 may penetrate a through hole 921 formed in the front panel 92. Each of the four surface pressing buttons 91 includes the surface pressing part 911, a switch pressing part 912 integrally formed with the surface pressing part 911, and a supporting part 913 to support the surface pressing part 911 and the switch pressing part 912.

The supporting part 913 includes a boss hole 914 to which a boss 922 of the front panel 92 which will be described later is inserted, and a hinge 915 which is connected to the surface pressing part 911 and supported so as to be cantilevered. As shown in FIGS. 7A and 7B, the supporting part 913 supports the four surface pressing buttons 91 arranged in line through the hinges 915. An inclination preventing part 916 integrally formed with the supporting part 913 to prevent the surface pressing button 91 from inclining is formed between both ends and the adjacent surface pressing buttons 91. The boss hole 914 is also formed at the distal end of the inclination preventing part 916.

At this time, the boss 922 penetrates the boss hole 914 formed in the supporting part 913. An end of the boss 922 penetrating the boss hole 914 is heated to be fused and welded together to be fixed to the boss hole 914.

A substrate 93 is provided on the side of the switch pressing part 912 of the surface pressing button 91, and a switch 94 is also provided on the side of the switch pressing part 912. The switch 94 is mounted on the substrate 93 and a small space is formed between the switch 94 and the switch pressing part 912.

When the surface pressing button 91 presses the surface pressing part 911, the hinge 915 of the supporting part 913 bends, and an end of the switch pressing part 912 is moved downward. The switch 94 is arranged in the moving direction of the end of the switch pressing part 912. Thus, when the switch pressing part 912 is moved downward, the switch 94 is pressed by the switch pressing part 912.

When the surface pressing button 91 is pressed by strong force, the switch 94 receives a large load from the switch pressing part 912 and it could be damaged. In order to prevent the strong force from being applied to the switch 94, the front panel 92 includes a hook 923 to prevent an end opposite to the hinge 913 of the surface pressing part 911 from being moved too much. The hook 923 is formed adjacent to the through hole 921 as shown in FIG. 7A. The hook 923 is integrally formed with the front panel 92. When the hook 923 engages with the surface pressing part 911, the surface pressing part 911 and the switch pressing part 912 are prevented from being turned.

When the surface pressing part 911 of the surface pressing button 91 is pressed, the surface pressing part 911 and the switch pressing part 912 are turned around the hinge 913 for a certain amount and then the end of the surface pressing part 911 comes into contact with the hook 923 and it is stopped. Thus, a large load is prevented from being applied to the switch 94.

Japanese Unexamined Utility Model Publication No. 06-9023 (1994) discloses that a stopper rib is formed on a switch knob and, when the switch knob is pressed, the stopper rib abuts on a substrate holder to restrict an operation of the switch knob.

Japanese Unexamined Patent Publication No. 2004-39324 discloses that a stopper is provided on each side of a pressing part and, when a button is pressed, the stopper comes into contact with a substrate and prevents the button from being pressed more than needs.

The surface pressing button 91 includes the supporting part 913 and the boss hole 914 formed at the distal end of the inclination preventing part 916 which extends from the supporting part 913. When the surface pressing button 91 is mounted on the front panel 92, the boss 922 is inserted into the each boss hole 914. However, since the hook 923 which engages with the surface pressing part 911 to restrict the movement of the surface pressing part 911 is mounted on a position close to the through hole 921 in the front panel 92, when the surface pressing button 91 is mounted, the surface pressing part 911 comes into contact with the hook 923 also, so that it is difficult to mount the surface pressing button 91 on the front panel 92.

In case that the hook 923 is formed of a material having a certain degree of flexibility, when the surface pressing button 91 is mounted on the front panel 92, the hook 923 is bent and the surface pressing part 911 can easily engage with the through hole 921. However, since the hook 923 is flexible, it cannot support a force applied from the surface pressing part 911 sufficiently in some cases.

Although it may be considered that the hook 923 and the front panel 92 are manufactured separately and after the surface pressing button 91 is mounted on the front panel 92, the hook 923 is mounted, in this case, it is troublesome to mount the hook 923 and the hook 923 cannot support the force applied from the surface pressing button 911 in some cases.

Although it may be considered that lengths of the boss 922 and the boss hole 914 are shortened, some play is provided between the boss 922 and the boss hole 914 and the surface pressing button 91 is tilted when it is mounted, in this case, the surface pressing button 91 could be unstably fixed because the lengths of the boss 922 and the boss hole 914 are shortened.

SUMMARY OF THE INVENTION

The present invention has been made in order to solve the aforementioned problems and it is an object of the present invention to provide a surface pressing button which can be surely and easily mounted on a back surface of a front panel and prevent a switch from receiving a large load, and an electronic device including the surface pressing button.

In order to achieve the aforementioned object, the present invention provides an electronic device including a front panel in which a through hole is formed, and a surface pressing button which is mounted on a back surface of the front panel and presses a switch. Herein, the surface pressing button includes a surface pressing part a portion of which is exposed from the through hole of the front panel, a switch pressing part which is integrally formed with the surface pressing part, a supporting part which supports the surface pressing part, and a hinge which connects the surface pressing part to the supporting part. The surface pressing part includes a projection which projects from an end on a side opposite to an end connected to the hinge. The supporting part includes a supporting frame which is in contact with the front panel and supports the surface pressing part through the hinge, an auxiliary supporting frame which is in contact with the front panel and is formed opposed to the supporting frame across the surface pressing part, a boss hole which is formed in each of the supporting frame and the auxiliary supporting frame, and is fitted and welded to a boss formed on the back surface of the front panel, and a reinforcing part which connects the supporting frame to the auxiliary supporting frame. The auxiliary supporting frame includes a stopper hole in which a portion on the side of the front panel is open, and a portion of the projection is provided, and a stopper which restricts movement of the projection, at the opposite end of the opening of the stopper hole.

According to this configuration, since the projection, the stopper hole, and the stopper are integrally formed, the surface pressing button can be smoothly mounted on the front panel.

In addition, according to this configuration, since the projection, the stopper hole, and the stopper are integrally formed, the surface pressing part of the surface pressing button can be promptly and accurately arranged in the through hole of the front panel.

According to the aforementioned configuration, a plurality of surface pressing parts may be provided, and the supporting part may support the plurality of surface pressing parts arranged in line. In addition, according to the aforementioned configuration, the switch pressing part may press a switch at the opposite end of the surface pressing part, and the switch pressing part may be turned around the hinge to press the switch.

In order to achieve the aforementioned object, the present invention also provides a surface pressing button mounted on a back surface of a front panel in which a through hole is formed. The surface pressing button includes a surface pressing part in which a portion thereof is exposed from the through hole of the front panel, a switch pressing part which is integrally formed with the surface pressing part, a supporting part which supports the surface pressing part, and a hinge which connects the surface pressing part to the supporting part. Herein, the surface pressing part includes a projection which projects from an end on a side opposite to an end connected to the hinge. The supporting part includes a supporting frame which is in contact with the front panel and supports the surface pressing part through the hinge, an auxiliary supporting frame which is in contact with the front panel and is formed opposed to the supporting frame across the surface pressing part, a boss hole which is formed in each of the supporting frame and the auxiliary supporting frame, and is fitted and welded to a boss formed on the back surface of the front panel, and a reinforcing part which connects the supporting frame to the auxiliary supporting frame. The auxiliary supporting frame includes a stopper hole in which a portion on the side of the front panel is open, and a portion of the projection is provided, and a stopper which restricts movement of the projection, at the opposite end of the opening of the stopper hole.

According to this configuration, since the projection, the stopper hole, and the stopper are integrally formed, the surface pressing button can be smoothly mounted on the front panel.

In addition, according to this configuration, since the projection, the stopper hole, and the stopper are integrally formed, the surface pressing part of the surface pressing button can be promptly and accurately arranged in the through hole of the front panel.

According to the aforementioned configuration, a plurality of surface pressing parts may be provided, and the supporting part may support the plurality of surface pressing parts arranged in line.

In addition, according to the aforementioned configuration, the switch pressing part may press a switch at the opposite end of the surface pressing part, and the switch pressing part may be turned around the hinge to press the switch.

DESCRIPTION OF THE DRAWINGS

These and other objects and features of the present invention will become more apparent from the following detailed description of the present invention when taken in conjunction with the following accompanying drawings.

DESCRIPTION OF THE PREFERRED EMBODIMENTS

Figure 1:
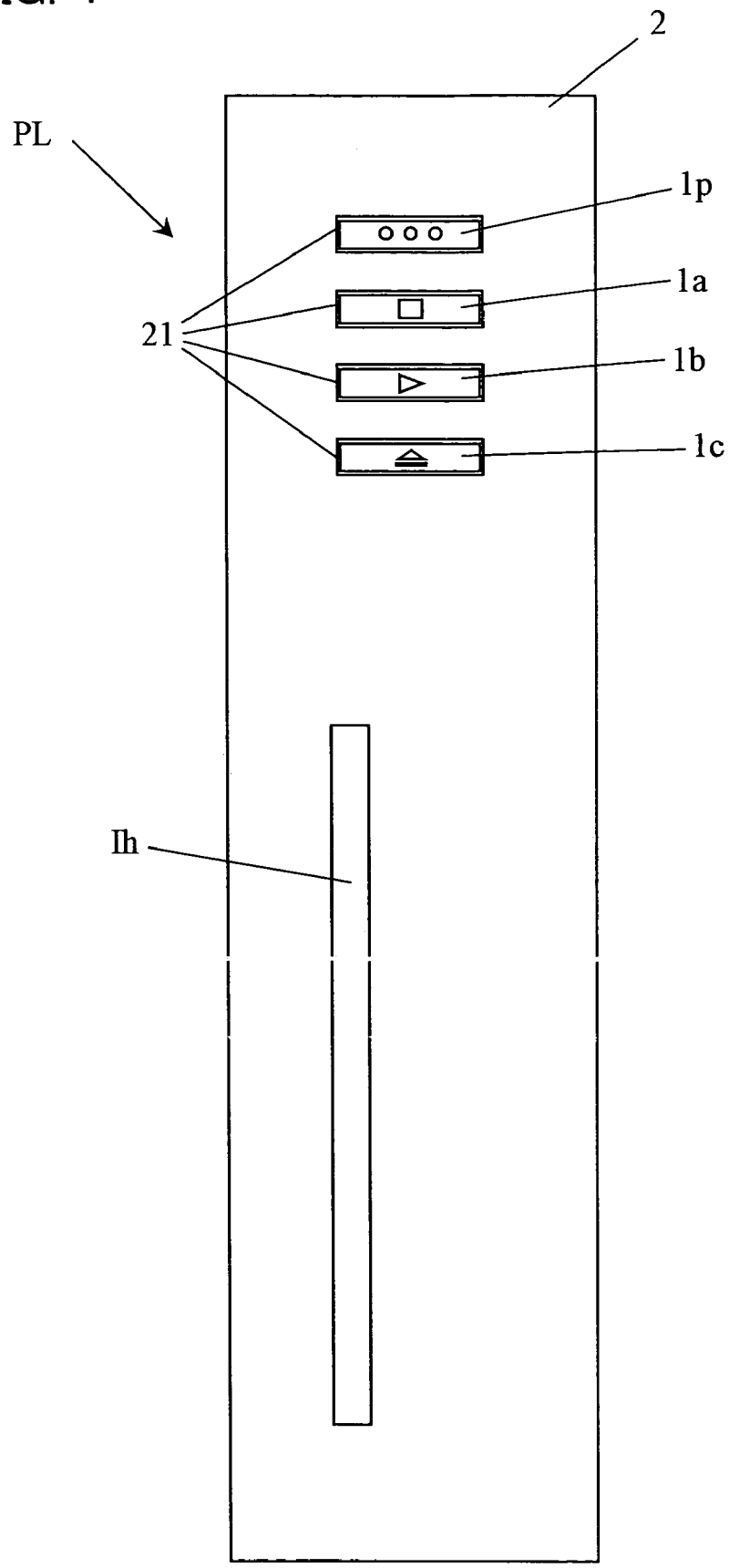
FIG. 1 is a front view showing an example of an electronic device according to the present invention.

Hereinafter, an embodiment will be described with reference to the drawings. FIG. 1 is a front view showing an example of an electronic device according to the present invention. An electronic device shown in FIG. 1 is a DVD player; however, the present invention is not limited thereto. The DVD player PL shown in FIG. 1 includes a slot Ih for a DVD medium, a power supply button 1 (1*p*), a stop button 1 (1*a*), a playback (pause) button 1 (1*b*), a medium ejection button 1 (1*c*) to eject the DVD medium, and a front panel 2.

Each of the power supply button 1*p*, the stop button 1*a*, the playback button 1*b* and the medium ejection button 1*c* is pressed to perform an operation related to each button. Through holes 21 are formed in the front panel 2 and the respective buttons 1*p*, 1*a*, 1*b* and 1*c* penetrate the through holes 21.

Figure 2:
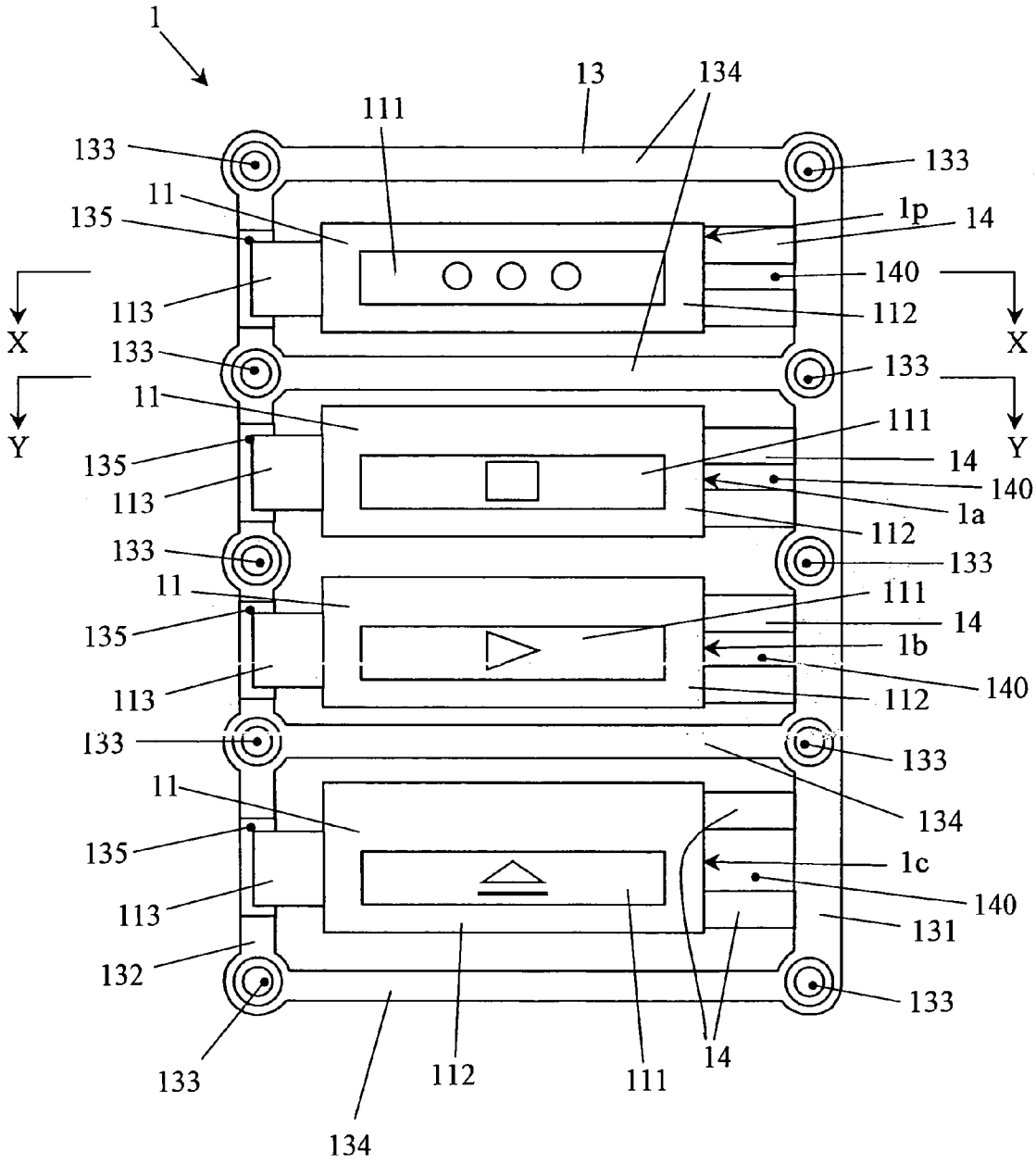
FIG. 2 is a front view showing surface pressing buttons according to the present invention.
Figure 3:
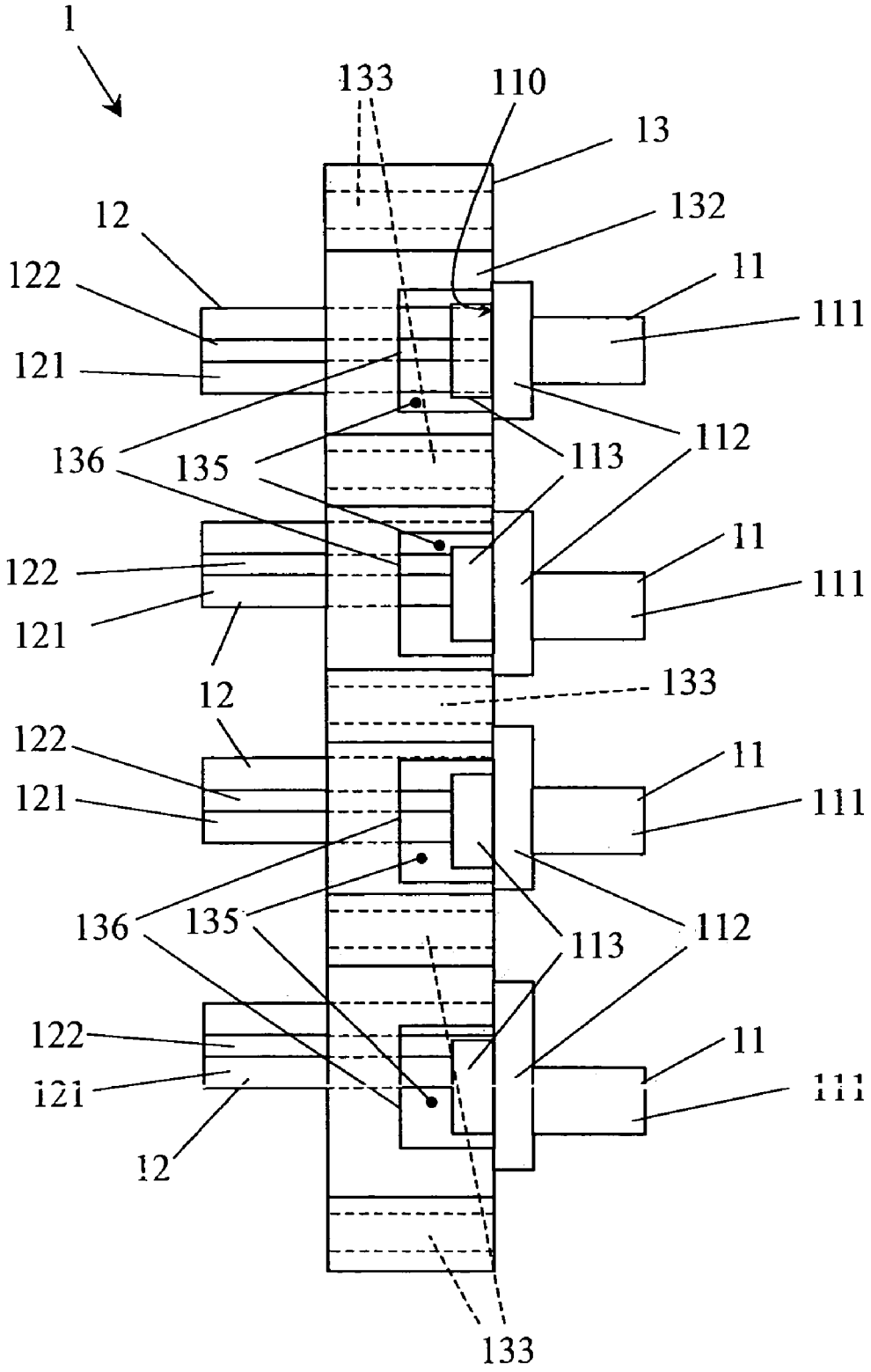
FIG. 3 is a side view showing the surface pressing buttons shown in FIG. 2.

FIG. 2 is a front view showing the surface pressing buttons according to the present invention, and FIG. 3 is a side view showing the surface pressing buttons shown in FIG. 2. The surface pressing buttons 1 include the power supply button 1*p*, the stop button 1*a*, the playback button 1*b* and the medium ejection button 1*c*. Each button has the same constitution and includes a surface pressing part 11 penetrating the through hole 21 of the front panel 2, and a switch pressing part 12 integrally connected to the surface pressing part 11. A manufacturing method of the surface pressing button 1 is an integral molding of resin in this example; however, the present invention is not limited thereto.

The surface pressing button 1 includes a supporting part 13, and the supporting part 13 is connected to the surface pressing part 11 through a hinge 14. As shown in FIG. 2, the surface pressing part 11 has a distal end 111 penetrating the through hole 21 of the front panel 2, a base 112 preventing the surface pressing button 11 from projecting from the through hole 21 too much and connected to the hinge 14, and a projection 113 connected to an opposite side of the base 112 connected to the hinge 14.

The supporting part 13 includes a supporting frame 131 supporting the adjacent surface pressing parts 11 and the switch pressing parts 12 arranged in line, an auxiliary supporting frame 132 formed on a side opposite to the supporting frame 131 across the surface pressing part 11 (at a position opposed to the supporting frame across the surface pressing part 11), a boss hole 133 in which a boss 22 formed on a back surface 20 of the front panel 2 as will be described below is to be externally fitted, and a reinforcing part 134 connecting the supporting frame 131 to the auxiliary supporting frame 132.

The auxiliary supporting frame 132 has a stopper hole 135 to which a portion of the projection 113 of the surface pressing part 11 is inserted. The stopper hole 135 is open in a direction that the surface pressing button 1 is mounted on the front panel 2, and a stopper 136 is formed on its opposite side.

Five boss holes 133 are provided in each of the supporting frame 131 and the auxiliary supporting frame 132, that is, ten boss holes 133 are provided in total; however, the present invention is not limited thereto. The boss holes 133 of the supporting frame 131 are formed at both ends and between the hinges 14. The boss holes 133 of the auxiliary frame 132 are formed at both ends and between the stopper holes 135.

As described above, the reinforcing parts 134 connect the supporting frame 131 to the auxiliary supporting frame 132 and they are formed at both ends and between the power supply button 1*p* and the stop button 1*a* and between the playback button 1*b* and the medium ejection button 1*c*. In addition, although the present invention is not limited to the above, a component can be arranged variously so that the surface pressing button 1 may have some strength. In addition, as shown in FIG. 2, a through hole 140 is formed in the center of the hinge 14.

Figure 4A:
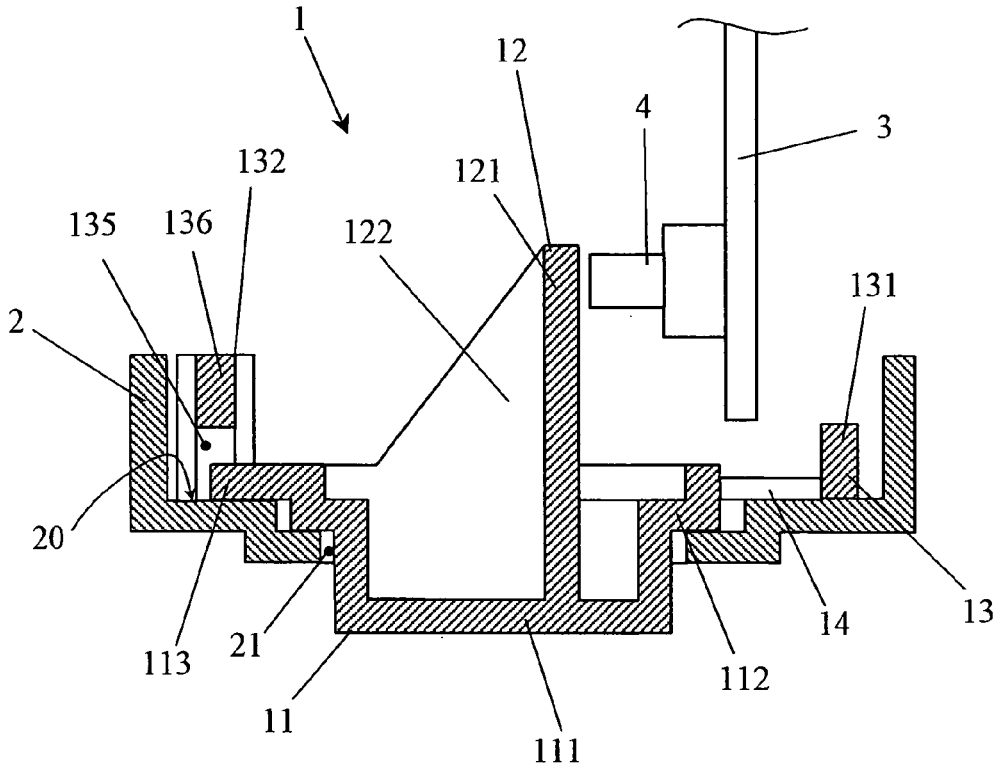
FIG. 4A is a sectional view showing the electronic device including the surface pressing button, taken along line X—X in FIG. 2.
Figure 4B:
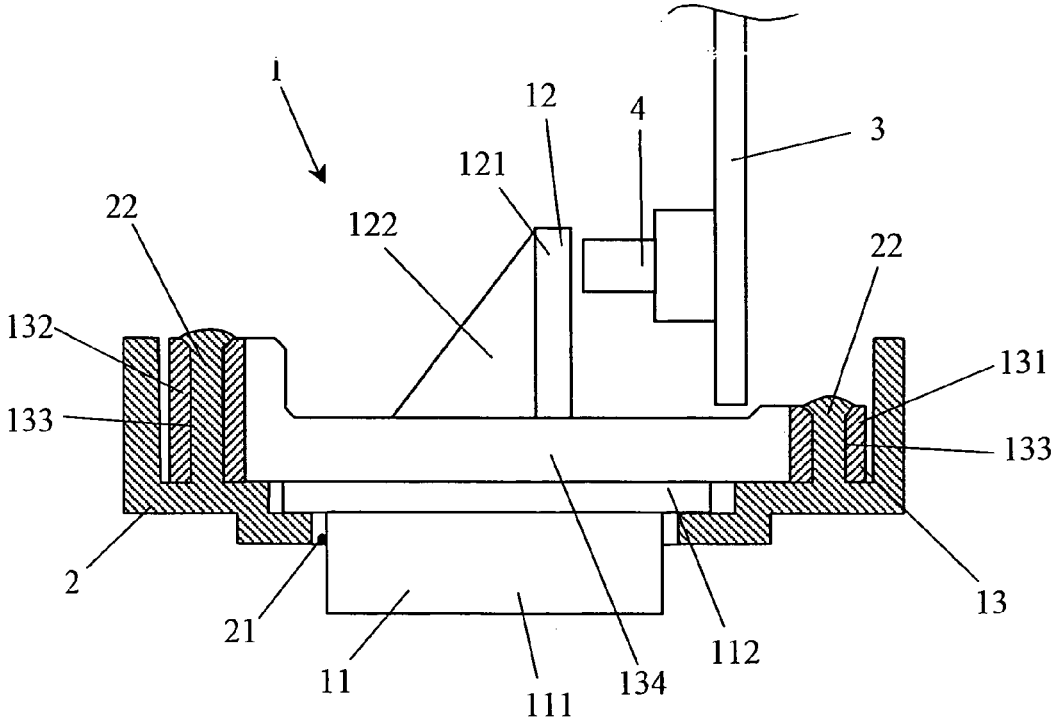
FIG. 4B is a sectional view showing the electronic device including the surface pressing button, taken along line Y—Y in FIG. 2.

FIG. 4A is a sectional view showing the electronic device including the surface pressing button, taken along line X—X in FIG. 2, and FIG. 4B is a sectional view showing the electronic device including the surface pressing button, taken along line Y—Y in FIG. 2. As shown in FIG. 4A, the base 112 of the surface pressing part 11 is in contact with the back surface 20 of the front panel 2. When the base 112 is in contact with the back surface 20 of the front panel 2, the distal end 111 of the surface pressing part 11 is prevented from projecting from the front panel 2 too much. In addition, the stopper hole 135 of the auxiliary supporting part 132 has a configuration in which its front surface is open, and the projection 113 is also in contact with the back surface 20 of the front panel 2.

As shown in FIGS. 4A and 4B, the switch pressing part 12 is connected to a back surface 110 of the surface pressing part 11. The switch pressing part 12 has a configuration in which it extends into the inside of the DVD player, and it is connected to the surface pressing part 11 and has a bottom plate 121 pressing a switch 4, and a reinforcing plate 122 integrally mounted on the center of the bottom plate 121 and connected to the surface pressing part 11. In addition, the switch 4 is mounted on a substrate 3 on the side of the switch pressing part 12. A small distance is formed between the switch 4 and the switch pressing part 12.

The base 112 is supported by the supporting part 13 so as to be cantilevered through the hinge 14. As shown in FIG. 4A, the hinge 14 has a small thickness in compared with the other parts of the surface pressing button 1. In addition, as described above, the through hole 140 is formed in the center of the hinge and rigidity (flexibility) of the hinge 14 is adjusted when the thickness of the hinge itself and a size of the through hole 140 are adjusted.

As shown in FIG. 4B, the boss 22 penetrating the boss hole 133 of the supporting part 13 is formed on the back surface 20 of the front panel 2. The boss 22 penetrates the boss hole 133 of the supporting part 13 and a projecting portion from the boss hole 133 is fused and welded to the boss hole 133. When the boss 22 and the boss hole 133 are welded, the surface pressing button 1 can be fixed to the back surface of the front panel 2.

When the distal end 111 of the surface pressing part 11 of the surface pressing button 1 is pressed from the outside of the front panel 2, the hinge 14 is bent and the surface pressing part 11 and the switch pressing part 12 are turned around the hinge 14. When the surface pressing part 11 and the switch pressing part 12 are turned, the bottom plate 121 of the switch pressing part 12 presses the switch 4. At this time, when the pressing part 11 is turned more than a predetermined range, the projection 113 formed in the surface pressing part 11 and inserted into the stopper 135 of the supporting part 13 comes in contact with the stopper 136 and the movement is stopped.

Thus, when the turning angle of the surface pressing part 11 of the surface pressing button 1 reaches a certain angle, the projection 113 comes into contact with the stopper 136. Therefore, when the switch 4 is pressed, the bottom plate 121 of the switch pressing part 12 is prevented from applying a strong force to the switch 4. Thus, since the switch 4 can be prevented from being damaged and the like, the surface pressing button 1 can be used for a long period of time. In addition, since the turning angle of the surface pressing part 11 is stopped at the certain angle, the hinge 14 can be prevented from being bent too much and prevented from being damaged by fatigue.

When the surface pressing button 1 is mounted on the back surface 20 of the front panel 2, it can be mounted thereon such a manner that the distal end 111 of the surface pressing part 11 may be inserted into the through hole 21 of the front panel 2 and the boss 22 provided on the back surface 20 of the front panel 2 may be fit in the boss hole 133 provided in the supporting part 13 of the surface pressing button 1. Thus, when the surface pressing button 1 is mounted on each member of the front panel 2, unreasonable force is prevented from being applied. As a result, the mounting process is performed so that a sufficient ability can be provided without damaging the surface pressing button 1 and the front panel 2.

Thus, since the surface pressing button 1 can be easily mounted on the back surface 20 of the front panel 2, manufacturing steps and its time can be reduced. In addition, since nothing hinders the surface pressing button 1 when it is mounted, the surface pressing button 1 and the front panel 2 can be prevented from being deformed or damaged due to unreasonable force applied to each part of them when they are repeatedly mounted and dismounted for being positioned.

Figure 5:
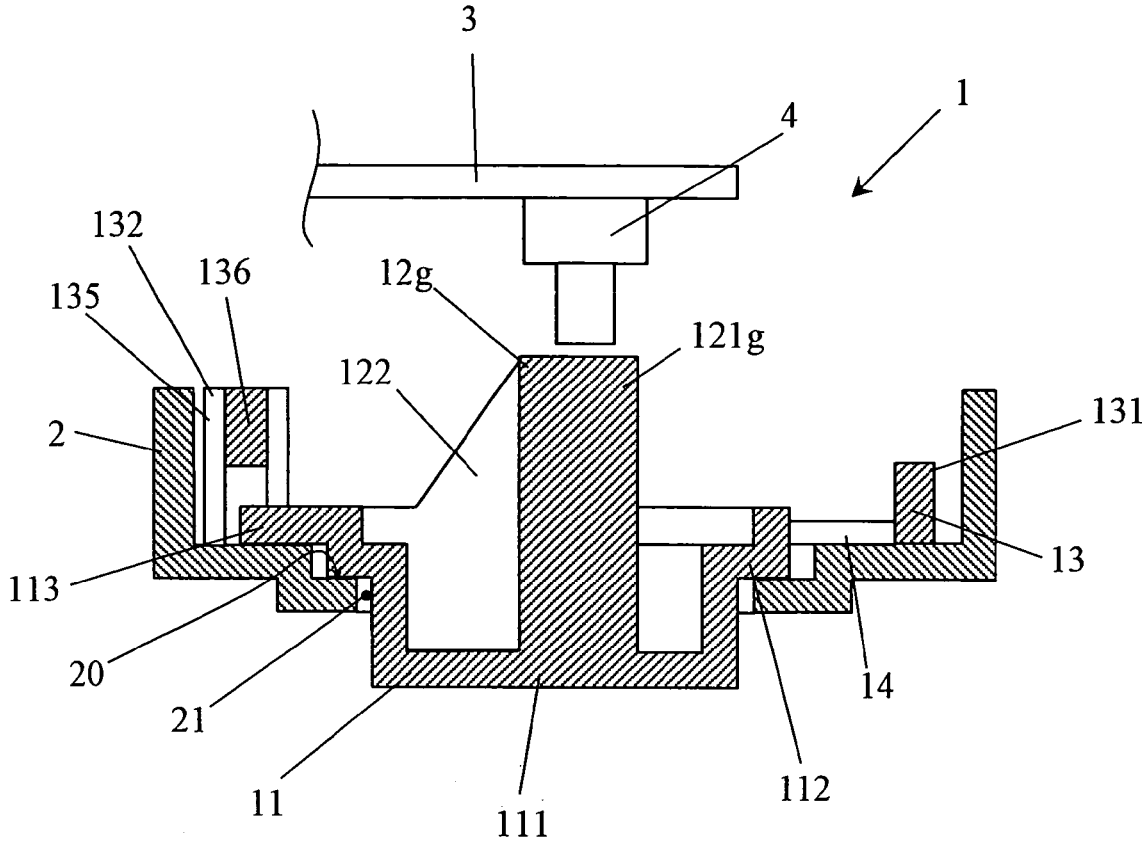
FIG. 5 is a sectional view showing another example of the surface pressing button according to the present invention.
Figure 6:
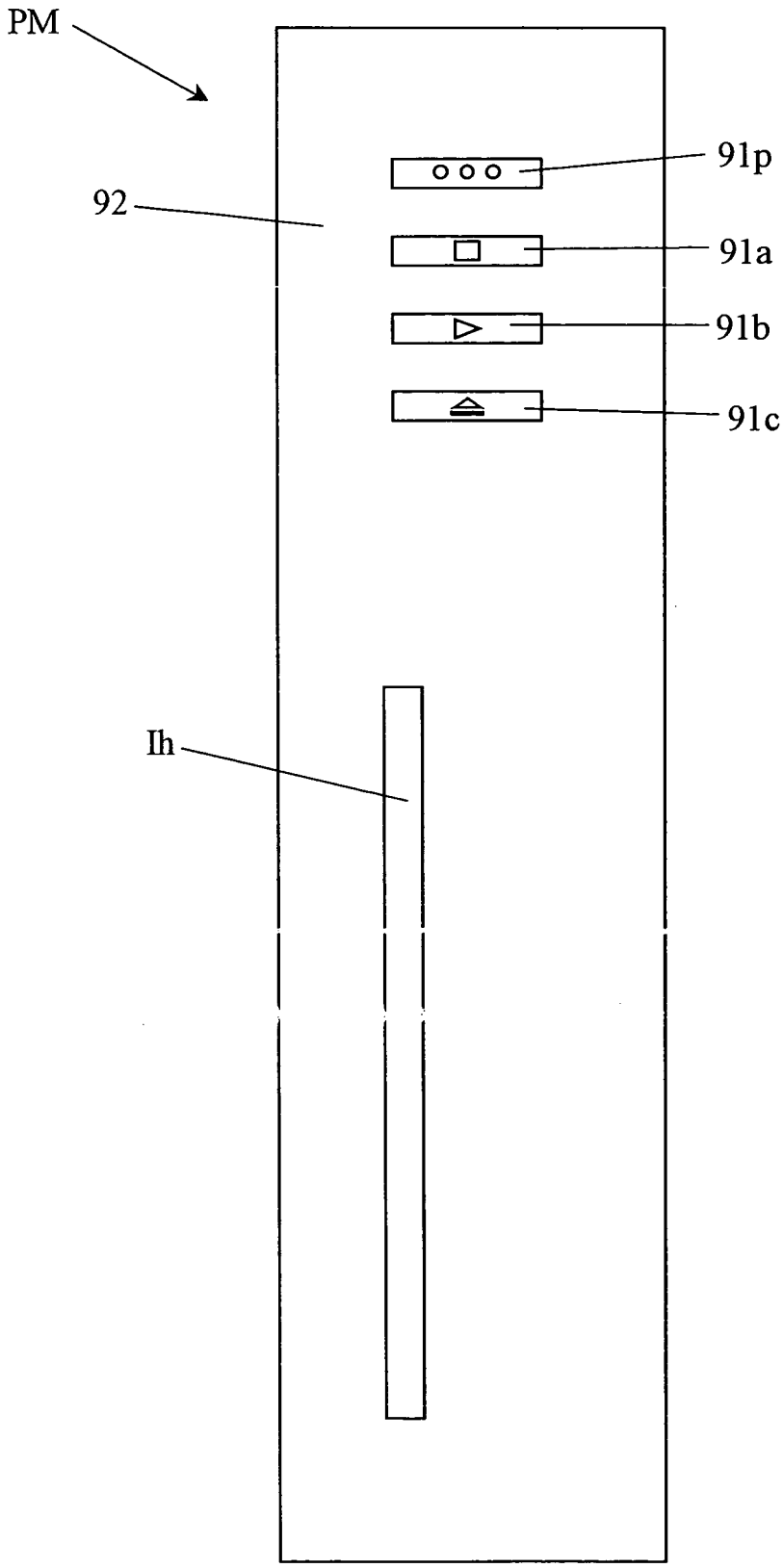
FIG. 6 is a front view showing an example of a conventional electronic device.
Figure 7A:
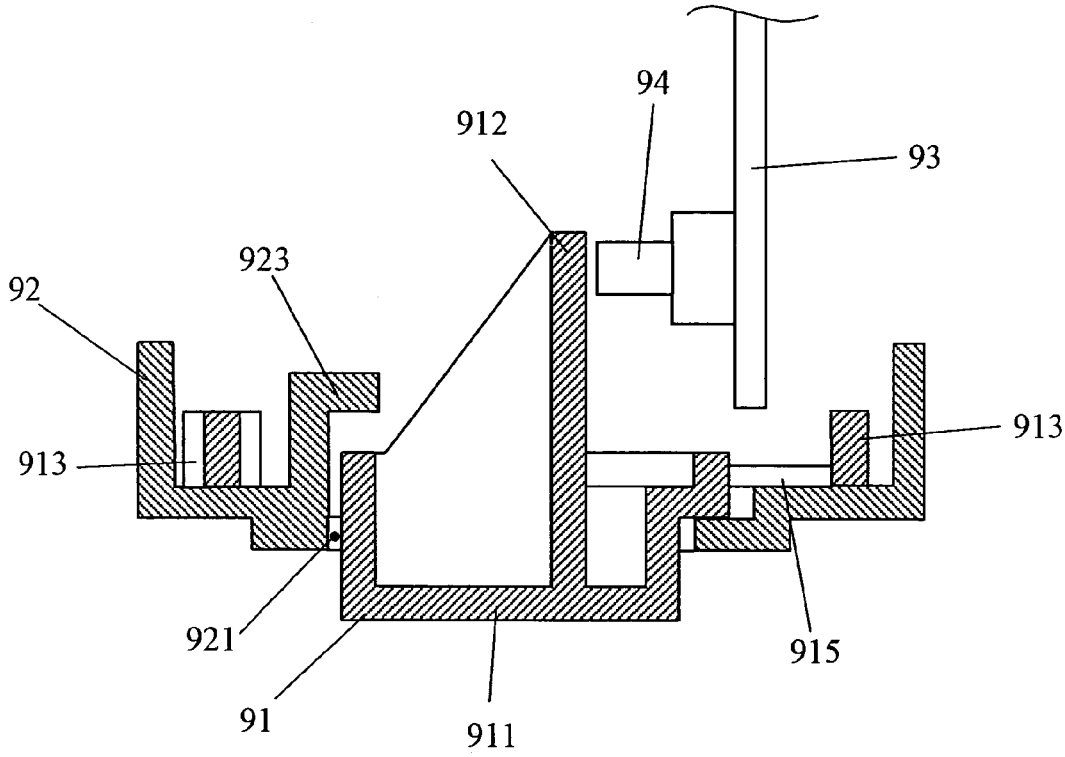
FIG. 7A is a sectional view showing a surface pressing button of the electronic device shown in FIG. 6.
Figure 7B:
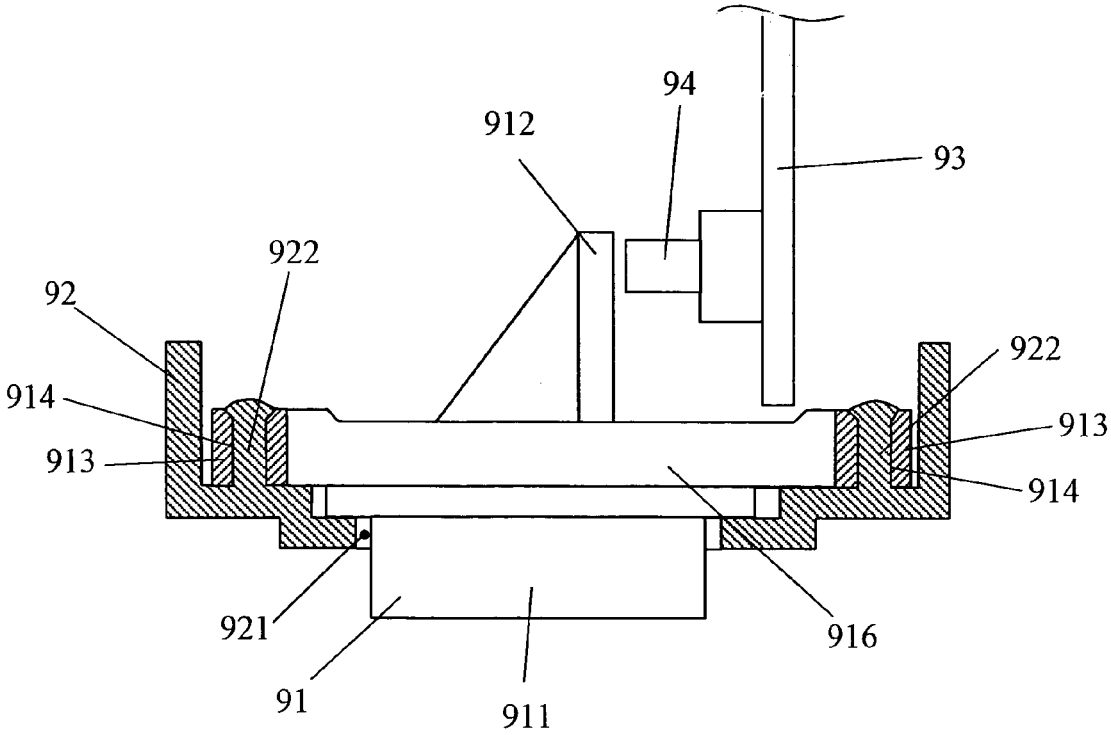
FIG. 7B is a sectional view showing a mounting part of the electronic device shown in FIG. 6.

FIG. 5 is a sectional view showing another example of the surface pressing button according to the present invention. A surface pressing button 1*g* shown in FIG. 5 is the same as the surface pressing button 1 shown in FIG. 2 and the like except for a switch pressing part 12*g*, in which the same numeral numbers are allotted to the same parts substantially.

The switch pressing part 12*g* of the surface pressing button 1 shown in FIG. 5 has a configuration in which it extends from a back surface of a surface pressing part 11. The switch pressing part 12*g* is formed so that a switch 4 is pressed by an end part 121*g* which is not connected to the surface pressing part 11. As shown in FIG. 5, in case of an electronic device in which the surface pressing button 1 and a substrate 3 are opposed, when the end 121*g* of the switch pressing part 12*g* which is not connected to the surface pressing part 11 is used to press the switch 4, a thickness of the electronic device can be reduced.

In addition, the four surface pressing buttons 1 include the power supply button 1*p*, the stop button 1*a*, the playback button 1*b*, and the medium ejection button 1*c* have been described according to the present invention; however, the present invention is not limited thereto and the number of buttons may be less than four or more than four.

The DVD player which plays the DVD medium is used as the electronic device in the aforementioned embodiment; however, the present invention is not limited thereto. The present invention can be applied to an electronic device which is operated with surface pressing buttons (a VTR, a CD, a TV receiver, for example).

According to the present invention described with reference to the aforementioned embodiment, the surface pressing button which can be surely and easily mounted on the back surface of the front panel without any complicated structure or addition of the component, and can be prevented from applying too much load to the switch, and the electronic device including such surface pressing button can be provided.

In addition, according to the present invention, since positioning precision is improved without addition of the component, the surface pressing button which can be easily mounted and manufactured in a short time at a low cost, and the electronic device including such surface pressing button can be provided.

Furthermore, according to the present invention, since a large load is prevented from being applied from the surface pressing button to the switch, even when the surface pressing button is repeatedly pressed, the switch can be prevented from being damaged and the like, so that the surface pressing button and the electronic device can be used for a long time of period.

What is claimed is:

1. A surface pressing button mounted on a back surface of a front panel in which a through hole is formed, comprising:

a surface pressing part in which a portion thereof is exposed from the through hole of the front panel;

a switch pressing part which is integrally formed with the surface pressing part;

a supporting part which supports the surface pressing part; and a hinge which connects the surface pressing part to the supporting part, wherein the surface pressing part includes:

a projection which projects from an end on a side opposite to an end connected to the hinge, the supporting part includes:

a supporting frame which is in contact with the front panel and supports the surface pressing part through the hinge;

an auxiliary supporting frame which is in contact with the front panel and is formed opposed to the supporting frame across the surface pressing part;

a boss hole which is formed in each of the supporting frame and the auxiliary supporting frame, and is fitted and welded to a boss formed on the back surface of the front panel; and a reinforcing part which connects the supporting frame to the auxiliary supporting frame, and the auxiliary supporting frame includes:

a stopper hole in which a portion on the side of the front panel is open, and a portion of the projection is provided; and a stopper which restricts movement of the projection, at the opposite end of the opening of the stopper hole.

2. The surface pressing button according to claim 1, wherein a plurality of surface pressing parts are provided, and the supporting part supports the plurality of surface pressing parts arranged in line.

3. The surface pressing button according to claim 1, wherein the switch pressing part presses a switch at the opposite end of the surface pressing part.

4. The surface pressing button according to claim 1, wherein the switch pressing part is turned around the hinge to press the switch.

5. An electronic device comprising:

a front panel in which a through hole is formed; and a surface pressing button which is mounted on a back surface of the front panel and presses a switch, wherein the surface pressing button includes:

a surface pressing part a portion of which is exposed from the through hole of the front panel;

a switch pressing part which is integrally formed with the surface pressing part;

a supporting part which supports the surface pressing part; and a hinge which connects the surface pressing part to the supporting part, the surface pressing part includes:

a projection which projects from an end on a side opposite to an end connected to the hinge, the supporting part includes:

a supporting frame which is in contact with the front panel and supports the surface pressing part through the hinge;

an auxiliary supporting frame which is in contact with the front panel and is formed opposed to the supporting frame across the surface pressing part;

a boss hole which is formed in each of the supporting frame and the auxiliary supporting frame, and is fitted and welded to a boss formed on the back surface of the front panel; and a reinforcing part which connects the supporting frame to the auxiliary supporting frame, and the auxiliary supporting frame includes:

a stopper hole in which a portion on the side of the front panel is open, and a portion of the projection is provided; and a stopper which restricts movement of the projection, at the opposite end of the opening of the stopper hole.

6. The electronic device according to claim 5, wherein a plurality of surface pressing parts are provided, and the supporting part supports the plurality of surface pressing parts arranged in line.

7. The electronic device according to claim 5, wherein the switch pressing part presses a switch at the opposite end of the surface pressing part.

8. The electronic device according to claim 5, wherein the switch pressing part is turned around the hinge to press the switch.

* * * * *